United States Patent [19]

Bernet et al.

[11] 4,036,603

[45] July 19, 1977

[54] APPARATUS FOR REMOVING SOLID MATTER FROM COAL TAR

[75] Inventors: Henri Georges Bernet, Sceaux, France; Théophile Martens, Ertvelde, Belgium

[73] Assignees: Societe Francaise d'Etude d'Installations Siderurgiques Sofresid, Montreuil, France; S.A. Sidmar, Gent, Belgium

[21] Appl. No.: 543,770

[22] Filed: Jan. 23, 1975

[30] Foreign Application Priority Data

Apr. 25, 1974 France ..... 74.14375

[51] Int. Cl.[2] ..... B30B 11/00; C10L 5/22; C10C 1/00

[52] U.S. Cl. ..... 44/13; 208/8; 208/39

[58] Field of Search ..... 44/13; 208/41, 39, 42, 208/8

[56] References Cited

U.S. PATENT DOCUMENTS

| | | | |
|---|---|---|---|
| 1,660,295 | 2/1928 | Goodwin | 208/39 X |
| 1,775,280 | 9/1930 | Greene et al. | 44/13 |
| 2,383,363 | 8/1945 | Batchelder | 208/42 X |
| 2,899,373 | 8/1959 | Steeves | 208/39 |
| 3,010,893 | 11/1961 | Kulik | 208/42 X |
| 3,674,449 | 7/1972 | Schmalfeld et al. | 44/13 X |

*Primary Examiner*—Carl F. Dees
*Attorney, Agent, or Firm*—Wenderoth, Lind & Ponack

[57] ABSTRACT

Process and apparatus for removing solid matter from coal tar recovered from coal distillation comprising the steps of centrifuging the tar in order to produce a liquid phase consisting of tar which is substantially free of residual solids and a solid phase consisting of solid matter and tar, and mixing the solid phase with a solid material comprising carbon.

5 Claims, 1 Drawing Figure

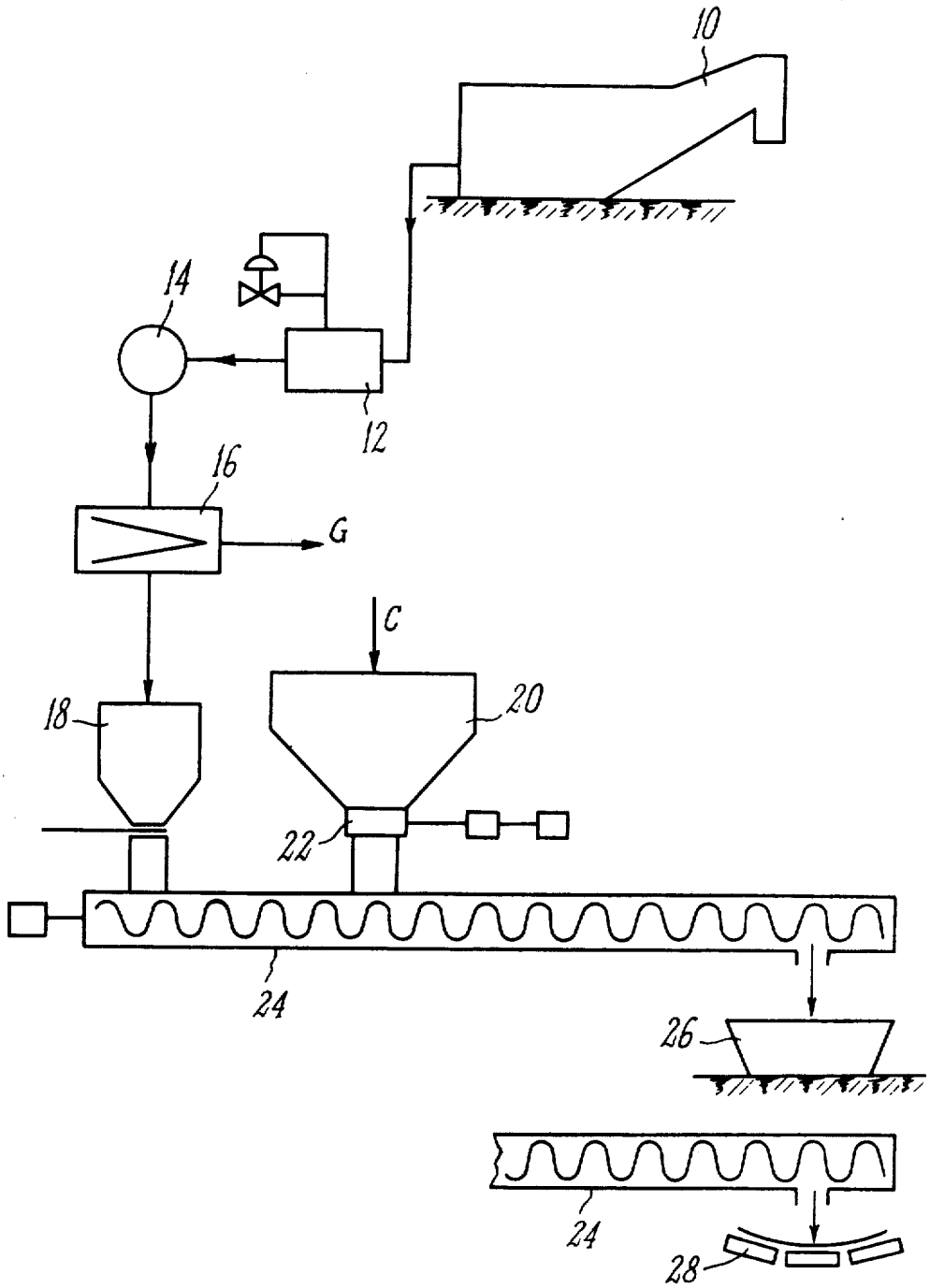
10
14
12
16
G
C
18
20
22
24
26
24
28

APPARATUS FOR REMOVING SOLID MATTER FROM COAL TAR

BACKGROUND OF THE INVENTION

The present invention relates to a process and apparatus for the removal of solid matter from coal tar. It is applicable to tar obtained during distillation of coal in any type of retort (such as coke ovens and gas retorts).

Tar is generally recovered from coal distillation by cooling of the raw gas from the retorts which causes condensation of water and tar followed by decantation of the condensate to separate water and tar.

It is well known that the raw gas leaving the retorts also contains a certain quantity of solid matter, normally in the form of dust which mainly consists of fine particles of carbon suspended in the gas.

In the majority of existing distillation processes this solid matter remains in the tar, in which it constitutes the major part of what is known as the solid residue of the tar. When the proportion of this solid residue is not too high its presence in the tar does not cause serious difficulties and is generally tolerated.

However in the operation of certain processes which are used more and more in modern installations (involving, for example, coal which is ground to a very fine size, charging of coal to the retorts at an increasingly low water content or even of dry coal, aspiration of charging fumes, and sealing of the condenser or condensers in order to avoid atmospheric pollution) the quantity of dust entrained in the tar becomes greater to the point where its presence constitutes a serious disadvantage which may become inacceptable.

SUMMARY OF THE INVENTION

The present invention is directed to the objective of providing a process and apparatus for separating this solid matter from the tar, which process is applicable to an early stage of treatment of tar obtained from coal distillation.

According to one aspect of the present invention, there is provided a process for removing solid matter from coal tar in which the tar is centrifuged to produce a liquid phase consisting of tar which is substantially free of residual solids and a solid phase consisting of solid matter and tar, and mixing the solid phase with a solid material comprising carbon.

According to another aspect of the invention, there is provided apparatus for removing solid matter from coal tar, which comprises a centrifuge for separating the tar into a substantially solid-free liquid phase and a solid phase containing tar, a duct arranged to receive the solid phase from the centrifuge and deliver it to a heatable screw mixer and a hopper arranged to deliver a solid material comprising carbon to the screw mixer to be mixed with the solid phase therein.

BRIEF DESCRIPTION OF THE DRAWINGS

A preferred embodiment of the invention will be described by way of example with reference to the accompanying drawing, which is a schematic diagram showing an apparatus according to the invention. The various components of the apparatus may be of known type.

DETAILED DESCRIPTION OF THE INVENTION

Tar obtained by condensation from gas obtained from a retort (not shown) is separated from water in a decanter 10 from which it is fed to the rest of the apparatus. It is necessary that this tar should be sufficiently fluid to allow efficient centrifuging. It is therefore necessary, if its temperature is not sufficient, to reheat it before any later treatment. It will be understood that the optimum temperature of reheating varies according to the nature of the tar (in fact, according to the nature of the coal used and the thermal treatment used in the retorts). For this purpose, the installation comprises a reheater 12 which may use steam or electricity as a source of heat.

At the exit of this reheater 12 there is positioned a pump 14 which feeds the tar at the desired temperature to a centrifuge 16. This centrifuge effects separation of the tar which is fed to it into two phases: a liquid phase, formed of tar which is practically free of solid matter, and a solid phase formed by the separated solid matter which is wetted with tar. If the separation of water from the tar has not been effected efficiently during decantation (especially because of the high content of solid matter) the centrifuge should be provided with a third outlet to remove water which is separated in the same operation.

The liquid tar phase which is free from solid matter is discharged by the outlet G of the centrifuge towards a storage tank.

The solid phase formed by the solid residue containing tar obtained at the outlet of the centrifuge 16 is usually practically impossible to handle efficiently even by mechanical means because it is formed of a sticky intractable product. Consequently this residue is received in a duct 18, which is designed in such a manner as to avoid blockage by sticky material, and which directly feeds a heated transporting screw mixer 24. This screw mixer 24 is connected electrically to the centrifuge 16 so that the latter can be stopped immediately in the case of stoppage of the screw.

The apparatus further comprises a hopper 20 fed with raw coal or coke dust C. This hopper 20 is equipped at its bottom with a rotary distributor 22 feeding the heated screw transporter 24 with the raw coal or coke dust C. This distributor is controlled by a variable speed motor in order to adapt the feed of coal or coke dust as required and notably according to the physical properties of the product leaving the centrifuge 16 in order to obtain a mixture which is sufficiently dry to be handled easily.

The fresh coal C is mixed in the screw 24 with the solid residue delivered by the duct 18. There is thus obtained at the outlet of the mixing screw 24 a product which is easily handled and which is discharged to a storage receptacle 26 or to a transporter 28.

This product may be used for further treatments or it may be recycled into the retort for further distillation. It may be pressed into briquettes by means of a briquetting press.

What we claim is:

1. An apparatus for removing solid matter from coal tar recovered from a coal distillation operation, said apparatus comprising:

heating means for reheating said coal tar to achieve a desired degree of fluidity thereof;

centrifuging means for receiving the thus reheated coal tar and separating said coal tar into a first, liquid phase consisting of tar which is substantially free of residual solids and a second, solid phase consisting of solid matter wetted with tar;

a duct positioned to receive said second, solid phase from said centrifuging means;

an elongate screw mixer positioned to receive adjacent a first end thereof said second, solid phase from said duct;

hopper means for supplying a solid carbon-containing material to said screw mixer at a position downstream from said first end thereof; and said screw mixer comprising means for mixing said carbon-containing material with said second, solid phase to improve the handling properties of said second, solid phase.

2. An apparatus as claimed in claim 1, further comprising automatic means for stopping said centrifuging means when said screw mixer is stopped.

3. An apparatus as claimed in claim 1, wherein said hopper means is provided with a rotary distributor drivable by a variable-speed motor to deliver said solid carbon-containing material to said screw mixer at a variable rate.

4. An apparatus as claimed in claim 1, further comprising briquetting press means provided at a second end of said screw mixer for pressing into briquettes the mixture of said second, solid phase and carbon-containing material.

5. An apparatus as claimed in claim 1, wherein said centrifuging means is provided with an outlet means for discharging water from the centrifuged tar.

* * * * *